United States Patent [19]

Hosbein

[11] 4,119,279

[45] Oct. 10, 1978

[54] APPARATUS AND METHOD FOR ANTICIPATING AN EMPTY SPOOL CONDITION

[75] Inventor: Hugh W. Hosbein, Fort Wayne, IN

[73] Assignee: Mossberg Hubbard a Division of Wanskuck Company, Garret, Ind.

[21] Appl. No.: 822,952

[22] Filed: Aug. 8, 1977

[51] Int. Cl.[2] ..... B65H 75/00; B65H 25/04

[52] U.S. Cl. ..... 242/54 R; 242/36; 242/57

[58] Field of Search ..... 242/54 R, 52, 78, 78.1, 242/78.6, 78.8, 28, 36, 49

[56] References Cited

U.S. PATENT DOCUMENTS

| | | | |
|---|---|---|---|
| 1,300,257 | 4/1919 | Felland | 242/57 X |
| 1,988,255 | 1/1935 | Soons | 242/36 X |
| 2,910,555 | 10/1959 | Tunstall | 242/36 X |
| 2,948,258 | 8/1960 | Koechel | 242/57 X |
| 3,288,385 | 11/1966 | Markakis | 242/57 X |
| 3,292,170 | 12/1966 | D'Angelo | 242/57 X |

*Primary Examiner*—Edward J. McCarthy
*Attorney, Agent, or Firm*—Gust, Irish, Jeffers & Rickert

[57] ABSTRACT

A pressure sensitive valve is mounted on the barrel of a magnet wire spool to be closed by wire wrapped on the barrel. Superatmospheric pressure is maintained internally of the barrel which is released upon opening of the valve by removal of the wire from the spool. A pressure-sensing device activates in response to such pressure release to provide a warning signal or suitable control function.

26 Claims, 8 Drawing Figures

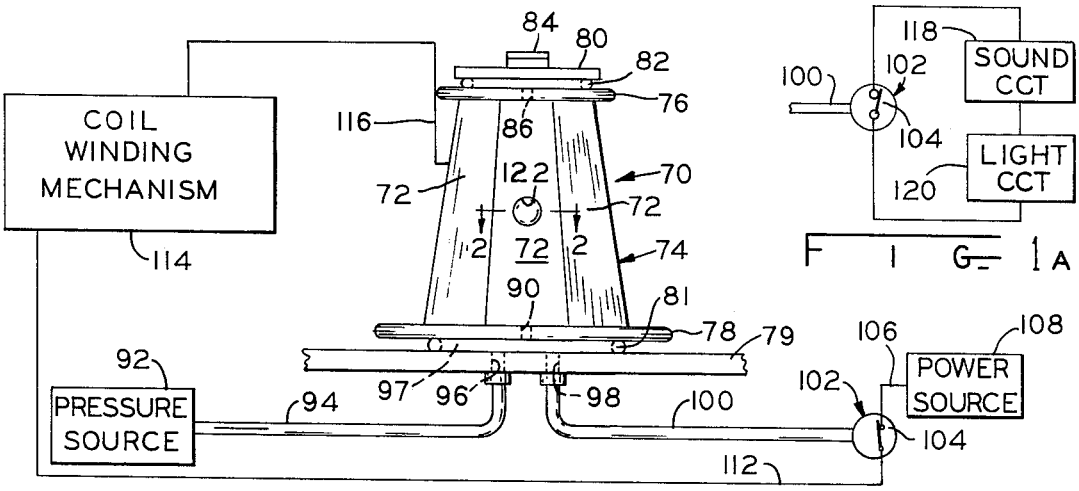
FIG. 1
FIG. 1A
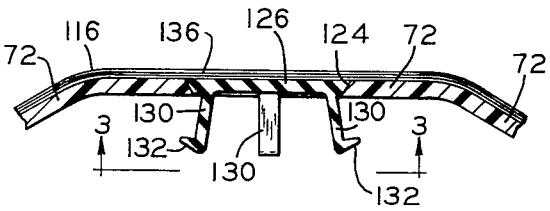
FIG. 2
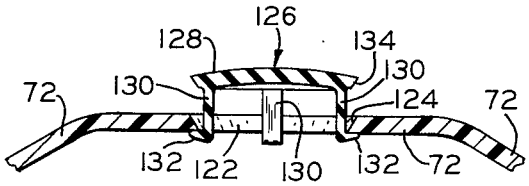
FIG. 4
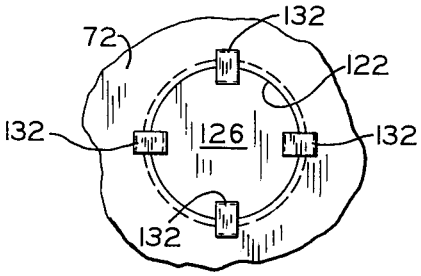
FIG. 3
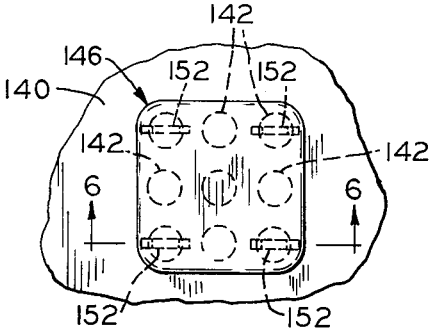
FIG. 5
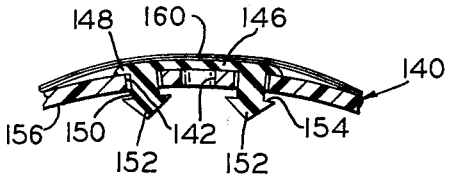
FIG. 6
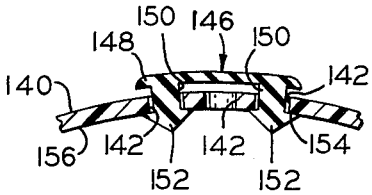
FIG. 7

APPARATUS AND METHOD FOR ANTICIPATING AN EMPTY SPOOL CONDITION

BACKGROUND OF THE INVENTION

1. Field of the Invention

This invention is in the field of wire carrying spools, and more particularly to a signaling or control device which is activated upon removal of the base layer of wire being payed from the spool.

2. Description of the Prior Art

Magnet wire from which magnetic coils are fabricated is conventionally stored on spools having a barrel provided with end flanges. A filled spool is conventionally fitted to apparatus for winding coils, the wire being payed off the spool being through the intermediary of a de-reeling device in some instances and in others directly from the spool mounted for rotation on an arbor. The condition of all of the wire is payed off or unwound from the spool, may go undetected unless the operator is observing the operation closely. If this condition is not observed, the coil-winding apparatus, which is usually electrically operated, continues to run until it is manually shut down. It frequently occurs that one person is in charge of operating a number of coil-winding machines such that the emptying of a particular spool often goes undetected.

SUMMARY OF THE INVENTION

A spool apparatus is provided with a hollow, air tight barrel and conventional end flanges. An opening in the barrel wall is fitted with a valve which seals the opening when a base layer of wire is normally coiled onto the barrel but breaks the seal when this layer or a portion thereof is removed. The valve is so arranged that superatmospheric pressure internally of the barrel unseats the valve to cause a drop in pressure, indicating exhaustion of the wire supply.

A pneumatic system is coupled to the barrel interior and comprises a source of low pressure air, a conduit leading from the source to the barrel interior, a second conduit leading from the barrel interior to a pressure operated sensing device such as an electrical switch, and a signaling or control device connected to the sensing device capable of producing a signal or control function in response to of the activation of the sensing device. During the unwinding of a loaded spool, as in the case of operation of coil-winding apparatus to which wire is being fed, the valve is closed by the wire on the barrel and air under pressure from said source fills the interior and is applied to the sensing device maintaining the latter deactivated. When the base layer of wire is reached and a predetermined number of coils are unwound, the valve is released permitting the escape of air from and reduction of pressure within the barrel. This pressure drop is communicated to the sensing device thereby activating it. A signaling or control device coupled to the sensing device is then energized thereby providing an indication or control function indicative that the spool is empty or nearly empty.

In one embodiment, the valve is in the form of a normally open poppet valve that is held closed by the contiguous wrapping of wire on the barrel. Various designs of barrel spools may be used such as round, tapered or polygonal.

An object of this invention is to provide a device method and an apparatus for generating a signal to warn or to provide a control signal indicative of an empty spool condition.

A still further object of this invention is to provide in the apparatus of the previous object means to automatically stop the unwinding of wire from a spool mechanism upon nearing an empty spool condition.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a side elevational view, partly diagrammatic, of an embodiment of this invention relating to an empty spool signaling device;

FIG. 1A is a diagrammatic view of a warning circuit which may be incorporated in the embodiment of FIG. 1;

FIG. 2 is an enlarged sectional view of one valve structure taken substantially at section line 2—2 of FIG. 1;

FIG. 3 is a partial view of the valve structure of FIG. 2 taken substantially at section line 3—3 of FIG. 2;

FIG. 4 is an enlarged partial section of the valve structure of FIG. 2 shown in an open, empty spool condition;

FIG. 5 is an enlarged view of a second embodiment of a valve for use with round spool bodies;

FIG. 6 is a fragmentary section taken substantially at section line 6—6 of the valve embodiment of FIG. 5 as applied to a round body and held in a closed valve position by wire windings; and FIG. 7 is an enlarged partial section similar to FIG. 6 showing the valve structure of FIG. 6 in open position as in a spool empty condition.

DESCRIPTION OF THE PREFERRED EMBODIMENT

The empty spool indicating or control apparatus of this invention may be used with various conventional barrel configurations such as round, tapered, polygonal and the like. For convenience in describing the apparatus, a spool having a polygonal barrel is first described.

Referring more particularly to FIGS. 1 through 4, a spool 70 has a polygonal barrel (actually octagonal) 74 having flat sides 72. Flanges 76 and 78 are hermetically attached to the opposite ends of the barrel 74 as shown. The barrel 74 has a hollow interior with the wall thereof being impermeable to the passage of air, and in operation of the apparatus is charged to a predetermined superatmospheric air pressure. The flange 76 secured to the upper end thereof is provided with a central opening 86. Superposed on the flange 76, which for convenience is provided with a flat upper surface, is weighted sealing plate or relief valve 80 having a gasket or O-ring 82 between it and the upper surface of the flange 76. A handle 84 is secured to the plate 80 for convenience in placing the plate 80 in position on and removing it from the flange 76. While in the illustrated embodiment the seal 82 is shown as being in the form of an O-ring coaxially positioned with respect to the opening 86, it is to be understood that any suitable sealing or gasket device may be used without departing from the spirit and scope of this invention. The purpose of the weighted sealing plate 80, 82 is to prevent the escape of air from the interior of the barrel 74 via the opening 86 and also to serve as a relief valve should pressure within barrel 74 exceed a predetermined level.

The plate 80 is selected to be of an appropriate weight to provide the necessary seal that will prevent the escape of a predetermined superatmospheric pressure within barrel 74 via the opening 86 as later explained. While the opening 86 is disclosed as being sealed by means of the valve plate 80 and gasket 82, still other valve means may be employed such as a rubber stopper (not shown) inserted into opening 86 which will eject upon exceeding the predetermined pressure in barrel 74 or a conventional air pressure relief valve (not shown) connected to opening 86 which will open under the same excessive pressure condition.

The spool 70 is rested on a flat element or bench top 79 with an O-ring seal 81 disposed between the upper surface of the top 79 and the flange 78. Again, this seal 81 may be in the form of an O-ring seal or suitable gasket thereby to provide an air tight chamber 97 between that portion of the flange 78 inside the seal 81 and the upper surface of the bench top 79. An opening 90 is provided centrally of the flange 78 for communication with the interior of the barrel 74. So mounted and with the valve plate 80 in position, the interior of the barrel 74 is in the form of a hermetically sealed air chamber.

A source 92 of low pressure air is connected by means of a conduit 94 to an opening 96 in the bench top 79 which communicates with the sealed chamber 97 between the flange 78 and the bench top 79. A like conduit 100 connects to another opening 98 in the bench top 79 which is also in communication with the chamber 97 and to a conventional low pressure, pneumatically operated electrical switch assembly 102. This switch assembly 102 contains either a diaphram or piston exposed to the pressure in the conduit 100 which carries the movable contact of a single pole single throw switch. In one embodiment it is preferred that under normal operating pressures in the conduit 100, the contacts of the electrical switch 104 of assembly 102 will be held closed, but upon reduction of this pressure to a predetermined level, the contacts will be opened. This switch 104 is connected in series with a suitable source 108 of electrical power and a coil-winding machine which receives wire payed off the spool 70 by means of conventional overhead de-reeling apparatus indicated diagrammatically by the line 116. When the switch 104 is closed, the power source 108 energizes the coil-winding mechanism 114 which functions in a conventional manner to produce wire wound products such as electric motor stators, magnets and solenoids.

Instead of controlling the operation of the coil-winding mechanism 114, the switch 104 may be connected in circuit with a sound-producing device 118 (FIG. 1A), such as a buzzer, and a warning lamp 120. A battery (not shown) may be connected in series with these elements 118 and 120 such that upon closure of the switch 104, both the buzzer 118 and the lamp 120 will be energized.

Mid-way between the ends of the spool 74 and centrally of one of the flats 72 is a chamfered circular opening 124, better shown in FIGS. 2 and 4. A flexible, relatively flat, rubber valve 126 is operatively mounted in this opening 124 and serves to close and seal the same when positioned as shown in FIG. 2 and to open the same as shown in FIG. 4. This valve 126 is provided with four divergent legs 130 arranged in quadrature terminating in upturned retaining tips 132, for operatively retaining the valve 126 assembled in the opening 124. As shown in FIG. 4, when the valve 126 is opened, the tips 132 engage the underside of the marginal portions of the opening 124 to thereby prevent withdrawal of the valve 126 from the opening 124.

In explaining the operation of the invention thus far described, it will be assumed that wire has been conventionally wound in multiple layers on the barrel 74 between the flanges 76 and 78, each layer consisting of a multiplicity of contiguous turns. Also it will be assumed that in operating the coil-winding mechanism 114 and de-reeling device 116, the de-reeling device is of the conventional, overhead type which directs the wire vertically off the spool 70 about flange 76 in feeding it to the mechanism 114. With the wire so wound on the barrel 74, coils 136 (FIG. 2) will hold the valve 126 in sealed position in the opening 124. As wire is payed off the spool 70, it will eventually reach the final layer contiguous with the barrel 74. As this final layer is payed off, it will eventually uncover the valve 126 permitting it to unseat in response to superatmospheric air pressure maintained in the barrel interior. The reduction in pressure in the barrel 74 is communicated to the pneumatic-sensing device 102 via the conduit 100. This results in opening the switch 104 (in this instance being maintained closed by the superatmospheric pressure) and severing the power to the coil-winding mechanism 114 causing it to shut down automatically.

In obtaining this operation, the interior of the barrel 74 is maintained at a predetermined pressure by means of the pressure source 92 and conduit 94. A suitable pressure is about ten pounds per square inch gauge. Air under pressure from source 92 is communicated to the chamber 97 via the line 96. The same pressure prevails inside barrel 74 by reason of the small flange aperture 90. Correspondingly, the same pressure prevails in conduit 100 maintaining pneumatic-sensing device 102 deactivated. Again, when the wire uncovers the valve 126 as previously explained, this internal barrel pressure will unseat the valve 126 permitting a reduction in the pressure internally of the barrel 74. This reduction in pressure communicated to chamber 97 is sensed as previously explained to sever the operating power for the mechanism 114.

Instead of using the sensing device 102 for the purpose of shutting down the mechanism 114, an audio-visual warning device in the form shown in FIG. 1A may be used. In this instance, the switch contacts are held open by the superatmospheric pressure. Upon a predetermined drop of pressure in line 100, both the devices 118 and 120 will be energized upon closure of the switch to warn the machine operator that the spool 70 is approaching empty condition.

A slightly different valve device is shown in FIGS. 5 through 7 for use in conjunction with a cylindrical barrel of uniform diameter or tapered. This barrel is shown in fragmentary form and indicated by the numeral 140. In the barrel wall, again mid-way between the barrel ends, a series of apertures 142, a total of nine as shown in the drawings, are arranged in columnar form. This valve 146 is relatively flat and flexible and of sufficient size to cover over and seal all nine of the openings 142. At the corners of this valve 146, which is shown shaped as a square, are four retaining stubs 150 which are received with clearance by four of the openings 142. Integrally formed on the ends of the stubs 150 are enlarged retaining heads 152 of a transverse dimension larger than the respective openings 142. As shown in FIG. 5, these heads 152 are flat, but may be conically shaped instead. The valve 146, stubs 150 and heads 152 are integrally molded preferably of some soft rubber-like material so that the heads 152 may be deformed in assembling stubs 150 through the respective holes 142. In closed condition, the valve 146 overlies and seals all of the openings 142. When opened, the valve 146 is spaced beyond the outer surface of the barrel 140 thereby providing an escape path for the air under pressure within the barrel to escape through the openings 142.

This embodiment of FIGS. 5 through 7 operates essentially identically to that of the previous figures, wire wrapped on the spool 140 as indicated by the numeral 160 in FIG. 6 holding the valve 146 closed. When this wire is payed off, the air under pressure inside the barrel forces the valve 146 open thereby providing the reduction in pressure sensed by the device 102.

The pressure relief valve 126 or 146 may be located at any desired point on the barrel between the ends thereof so as to obtain the desired sensing operation. This will depend upon the type of operation desired by an operator. This invention is particularly useful in preventing the expiration of wire off the spool 70, which usually is being drawn at high velocity, before parts being produced by the mechanism 114 have been completed, for preventing the freed wire end drawn off an empty spool from whipping violently through space before it is drawn into the mechanism 114 and thirdly to prevent damage to equipment in the event the end of the wire is tied to some portion of the spool such as the flange. In the latter instance, when the spool is totally empty, the spool can be forcefully carried against the de-reeling or coil-winding mechanism causing damage thereto.

In the use of this invention, and by locating the valve 126, 146 mid-way between the barrel ends, a warning is sounded or the winding machinery is shut down before all of the wire is payed off the spool. This permits manual operation of the coil-winding machinery for completing any products in the process of being wound before all of the wire is payed off the spool. This results in an economy with respect to maximizing the use of the wire on the spool to make completed parts with a minimum of waste, constitutes an item in safety in preventing a free end of wire off the spool from whipping violently and possibly injuring an operator, and further prevents the spool from being drawn against associated machinery should the free end be tied to some part of the spool.

The air pressure system of this invention operates at a constant, relatively low pressure, ten inches water column being typical. The relief valve 80 is so designed to tilt slightly to open should the pressure inside barrel 74 exceed ten inches water column, thereby maintaining the pressure relatively constant as the valve 80 will gravitationally close, when opened, as the pressure drops below ten inches. The pressure-sensitive device 102 is selected to be activated when the pressure in the barrel 74 drops a predetermined amount of, for example, five inches or to atmospheric. These parameters may, of course, be altered without departing from the spirit and scope of the invention.

While there have been described above the principles of this invention in connection with specific apparatus, it is to be clearly understood that this description is made only by way of example and not as a limitation to the scope of the invention.

What is claimed is:

1. Apparatus for sensing that wire being dispensed from a spool is nearing the end, comprising a spool having a barrel onto which wire may be wound and stored, said barrel being hollow and hermetically sealed, valve means for controlling the opening and closing of a pressure escape port in said barrel, said valve means being movable to closed position in response to wire being contiguously wound on said barrel and further being movable to opened position by pneumatic pressure in said barrel when such wire is removed from said barrel, and means for sensing the reduced pressure inside said barrel when said valve is opened.

2. The apparatus of claim 1 wherein said barrel has end flanges thereon and a source of air under pressure communicating with the interior of said barrel through one of said flanges.

3. The apparatus of claim 2 in which both flanges have openings communicating with the barrel interior, first means for selectively closing the opening in one flange, and second means for connecting said source with the opening in the other flange.

4. The apparatus of claim 3 in which said second means includes a hermetically sealed chamber defined between said other flange and a surface on which said spool is supported, said second means including a conduit leading from said source to said sealed chamber.

5. The apparatus of claim 4 in which said supporting surface extends horizontally and said spool is upright thereon, an annular seal provided between said other flange and said supporting surface thereby to further define said sealed chamber, said sensing means being connected to said chamber.

6. The apparatus of claim 5 in which said sensing means is a pneumatic pressure operated switch which is activated upon a predetermined pressure change being applied thereto, and a conduit connecting said sensing means to said chamber.

7. The apparatus of claim 6 in which said first means includes a plate removably superposed onto said one flange, an annular sealing element interposed between said plate and said one flange but surrounding the opening in the latter, said plate being gravitationally held in position on said one flange and movable under a predetermined pressure within said barrel interior thereby serving as a pressure relief valve.

8. The apparatus of claim 1 in which said port is in the wall of said barrel, a valve element disposed on the outer surface of said barrel movably retained in said port between closed and open positions, said valve element being movable radially inwardly of said barrel to close said port whereby wire contiguously wound on said barrel forces said valve element to closed position, said valve element having at least one retaining leg that extends through said port and carries on the distal end thereof a laterally projecting retaining lip, said lip engaging the marginal portion of said port upon movement of said valve element away from said barrel thereby to retain said valve element assembled to said barrel.

9. The apparatus of claim 8 in which said sealing portion of said valve element is essentially flat with a plurality of said retaining legs projecting therefrom, the edge of said port being chamfered and said sealing portion being intimately engageable with said edge such that said sealing portion is substantially flush with the external surface of said barrel when said port is closed, each said leg having an out-turned lip thereon which laterally extends beyond the dimension of said port.

10. The apparatus of claim 8 wherein said port includes a plurality of valve openings in adjacent relation, the sealing portion of said valve element is essentially flat and movable to overlie said valve openings in sealed relation, a plurality of retaining legs projecting therefrom and being received by respective ones of said valve openings, a deformable retaining lip on each leg which is of larger transverse dimension than the respective opening, each said leg being of a length as will permit radial movement of said sealing portion with respect to said barrel.

11. The method of anticipating an empty spool condition comprising the steps of maintaining a gas at superatmospheric pressure within the hollow barrel of a spool on which wire is wound for storage, reducing the pressure within said barrel when wire has been dispensed therefrom to a point at or near the end thereof, and sensing the reduction in pressure to provide an indication of such empty spool condition.

12. The method of claim 11 in which said barrel is provided with an exhaust port which is controlled by a valve, closing said valve by means of wire contiguously wound on said barrel and onto said valve whereby said superatmospheric pressure is maintained in said barrel, said reduction in pressure occuring when being drawn off said barrel uncovers said valve thereby permitting air to exhaust through said port.

13. The method of claim 12 including the steps of supplying air under pressure to the barrel interior to provide said superatmospheric pressure.

14. The method of claim 13 including the steps of deactivating coil-winding mechanism which is receiving wire from said spool in response to said sensing step.

15. The method of claim 13 including the steps of activating a warning device in response to said sensing step.

16. The method of claim 13 in which said spool is provided with openings in the opposite ends thereof, closing one of said openings by means of a pressure relief valve which opens to exhaust pressure from said barrel when it exceeds a predetermined level, and closing the other opening during the presence of the superatmospheric pressure in the barrel.

17. The method of claim 16 in which the closing of said other opening includes providing a closed air chamber in communication therewith, and in which air is supplied to said barrel by supplying it directly to said chamber from which it flows through said other opening into said barrel.

18. A wire-carrying spool device comprising a barrel about which a base layer and additional layer of wire may be wound, and sensing means mounted on said barrel at intermediate point on the barrel axis for providing an indication that a predetermined amount of wire of the base layer has been unwound from said barrel to said intermediate point.

19. A wire-carrying spool device comprising a barrel about which wire may be wound, and sensing means operatively associated with said barrel for providing an indication that a predetermined amount of wire has been unwound from said barrel, said sensing means includes a valve port in said barrel, said barrel being impervious to a gaseous fluid, valve means for selectively controlling the opening and closing of said port, said valve means being responsive to engagement by wire wound on said barrel to close said port and further responsive to a predetermined gaseous pressure within said barrel to open said port in the absence of such engagement.

20. The device of claim 19 in which flanges are provided on the barrel ends, said flanges in combination with said barrel defining a fluid chamber within said barrel.

21. The device of claim 20 wherein said valve means includes a valve element disposed on the outer surface of said barrel movably retained in said port between closed and open positions, said valve element being movable radially inwardly of said barrel to close said port whereby wire contiguously wound on said barrel forces said valve element to closed position, said valve element having at least one retaining leg that extends through said port and carries on the distal end thereof a laterally projecting retaining lip, said lip engaging the marginal portion of said port upon movement of said valve element away from said barrel thereby to retain said valve element assembled to said barrel.

22. The device of claim 21 in which said sealing portion of said valve element is essentially flat with a plurality of said retaining legs projecting therefrom, the edge of said port being chamfered and said sealing portion being intimately engageable with said edge such that said sealing portion is substantially flush with the external surface of said barrel when said port is closed, each said leg having an out-turned lip thereon which laterally extends beyond the dimension of said port.

23. The device of claim 22 wherein said port includes a plurality of valve openings in adjacent relation, the sealing portion of said valve element is essentially flat and movable to overlie said valve openings in sealed relation, a plurality of retaining legs projecting therefrom and being received by respective ones of said valve openings, a deformable retaining lip on each leg which is of larger transverse dimension than the respective opening, each said leg being of a length as will permit radial movement of said sealing portion with respect to said barrel.

24. The device of claim 20 wherein said flanges close the ends, respectively, of said barrel, at least one of said flanges having a passage therein which accommodates the flow of fluid therethrough.

25. The device of claim 24 including a passage for fluid flow in the other flange, and a relief valve device superposed on said other flange to close the last-mentioned passage but responsive to a predetermined pressure within said barrel to open the same.

26. The method of anticipating an empty spool condition of a spool having a barrel on which wire is wound comprising the steps of maintaining in a first position a pressure sensitive device mounted on the barrel at an intermediate point on the barrel axis by tangible pressure contact with said wire; moving said pressure sensitive device to a second position when said tangible pressure by said wire is released at said intermediate point; and sensing said second position to provide an indication of wire unwind to said intermediate point.

* * * * *